United States Patent [19]

Perry

[11] 4,333,365

[45] Jun. 8, 1982

[54] POWER PIPE TONGS

[76] Inventor: Robert G. Perry, 3000 Ashwood Dr., Evansville, Ind. 47711

[21] Appl. No.: 148,195

[22] Filed: May 9, 1980

[51] Int. Cl.[3] ..... B25B 17/00

[52] U.S. Cl. ..... 81/57.16; 81/57.18; 81/57.2

[58] Field of Search ..... 81/57.14, 57.16, 57.18, 81/57.2, 57.34

[56] References Cited

U.S. PATENT DOCUMENTS

| | | | |
|---|---|---|---|
| 2,405,757 | 8/1946 | Rowland | 81/57.18 |
| 2,668,689 | 2/1954 | Cormany | 81/57.16 |
| 4,092,881 | 6/1978 | Jurgens et al. | 81/57.34 |
| 4,246,809 | 1/1981 | Keast et al. | 81/57.16 |

*Primary Examiner*—James L. Jones, Jr.
*Attorney, Agent, or Firm*—Jenkins, Coffey, Hyland, Badger & Conard

[57] ABSTRACT

A power-driven apparatus for rotating a tubular member such as pipe includes a carriage for rotatably supporting a first rotatable member for receiving the tubular member, a second rotatable member for rotating the first rotatable member, and a bi-directional motor for rotating the second rotatable member in first and second directions to thereby rotate the first rotatable member in first and second directions. A pair of jaws for gripping the tubular member is pivotally mounted in opposed relationship to the first rotatable member, and roller bearings are carried by the second rotatable member for pivoting the jaws to engage the tubular member and through frictional contact with the jaws to rotate the tubular member and the first rotatable member in response to rotation of the second rotatable member in both the first and second directions. The second rotatable member is rotatably supported by and independently rotatable with respect to the first rotatable member.

17 Claims, 12 Drawing Figures

FIG. 1
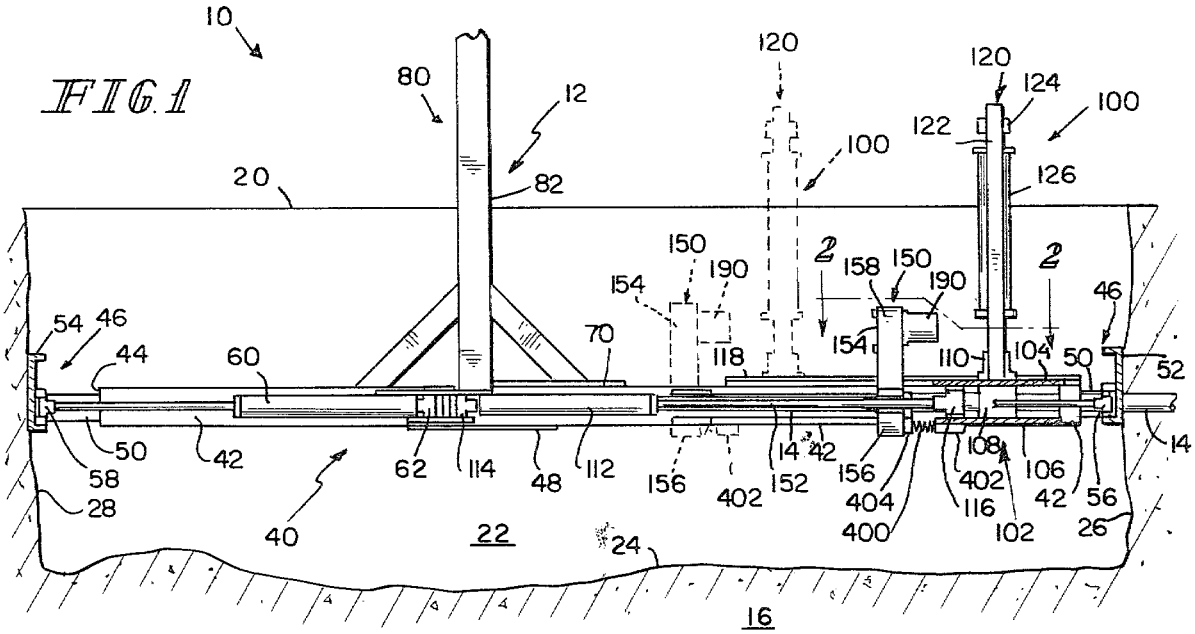
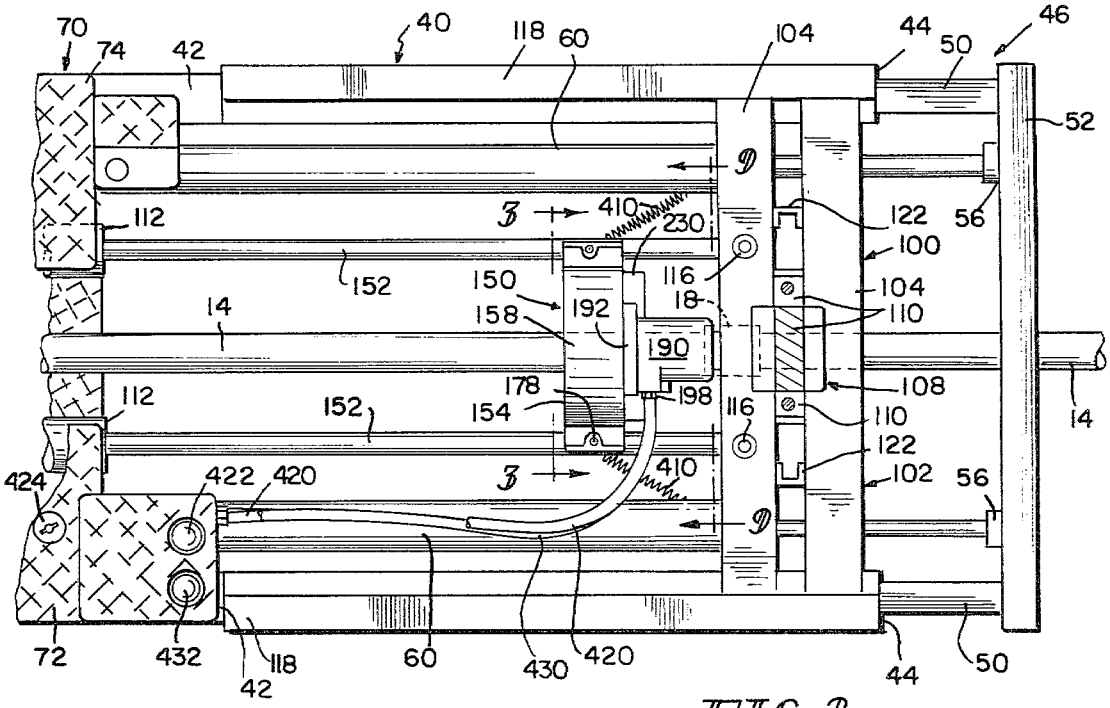
FIG. 2

POWER PIPE TONGS

In general, the present invention relates to devices employed to rotate a tubular member for the purpose of, for example, threadably connecting the tubular member to another tubular member. More particularly, the present invention relates to a power-driven apparatus for rotating a tubular member in both first and second directions and to improvements related thereto.

Generally speaking, power driven devices for rotating a pipe or tube are well known in the art and are represented by the following U.S. Pat. Nos. 2,150,611; 2,509,853; 2,552,521; 2,862,690; 2,952,177; 3,521,509; 3,550,485; 3,799,010; 3,832,918; 3,957,113; 4,095,493; and 4,170,907. While each of these patents discloses a device generally related to the apparatus of the present invention, it is believed that U.S. Pat. Nos. 2,862,690; 3,521,509; 3,550,485; 3,799,010; 4,170,907; and 4,095,493 are more pertinent to the present invention than the other patents because of either their general features or functional capabilities.

However, one of the problems associated with these conventional pipe-rotating devices is the limited amount of force which can be applied to rotate the pipe in two different directions. More particularly, there is no cooperation between the rotatable members and gripping members of these conventional devices so that the grip on the pipe can be increased when the force necessary to rotate the pipe must be increased. Accordingly, in these conventional devices, as the force required to rotate the pipe increases, it is possible for the grip on the pipe to release or slip. This problem exists in both devices which are only capable of rotating the pipe in a single direction and devices which are capable of rotating the pipe in two different directions.

As will become apparent from the disclosure provided herein, the apparatus of the present invention includes various improved features which not only solve the problem mentioned above but which also improve the efficiency and overall operation of power-driven apparatus for rotating pipe or similar tubular members.

It is therefore one object of the present invention to provide a power-driven apparatus for rotating a tubular member which is capable of rotating the tubular member in both a clockwise and counterclockwise direction without changing the position of the apparatus.

It is a further object of the present invention to provide a power-driven apparatus for rotating a tubular member in both clockwise and counterclockwise directions which includes rotatable means and gripping means which cooperate to increase the tightness of the grip on the tubular member as the force necessary to rotate the tubular member is increased. Accordingly, the apparatus of the present invention is capable of overcoming restrictions to the rotation of the tubular member without resulting in slippage or release of the grip on the tubular member.

According to the present invention, a power-driven apparatus for rotating a tubular member includes a carriage for rotatably supporting a first rotatable means for receiving the tubular member, a second rotatable means for rotating the first rotatable means, a bi-directional power means for rotating the second rotatable means in both clockwise and counterclockwise directions to thereby rotate the first rotatable means in both clockwise and counterclockwise directions, means for gripping the tubular member to rotate the tubular member in both clockwise and counterclockwise directions in response to corresponding rotation of the first and second rotatable means, means for pivotally mounting the gripping means to the first rotatable means, and means carried by the second rotatable means for pivoting the gripping means in response to rotation of the second rotatable means to engage the tubular member and through frictional contact with the gripping means to rotate the tubular member and the first rotatable means.

A further feature of the present invention is that in a pipe-handling mechanism of the type including a stationary frame structure and means carried by the frame for clamping and restricting rotation of a first pipe, a power-driven apparatus according to the present invention for gripping and rotating a second pipe in both first and second directions is axially movable relative to the first pipe to connect and disconnect the pipes, respectively. The apparatus includes a neutral axial position, a first axial position when the second pipe is rotated in the first direction to connect the pipes, and a second axial position when the second pipe is rotated in the second direction to disconnect the pipes. The apparatus further includes means for biasing it toward the neutral axial position from both the first and second axial positions when the grip on the second pipe is released.

Other features and advantages of the present invention will become apparent from the following detailed description of the embodiment thereof, which description should be considered in conjunction with the accompanying drawings in which:

FIG. 1 is a transverse side view, partly broken away and cross-sectioned, of a pipe-handling mechanism showing the adaptation of the power-driven apparatus of the present invention thereto;

FIG. 2 is a top section view, partly cross-sectioned, of the mechanism and apparatus of FIG. 1, taken generally along section lines 2—2 of FIG. 1 to further illustrate the relationship of the apparatus of the present invention to the pipe-handling mechanism;

Figure 3:
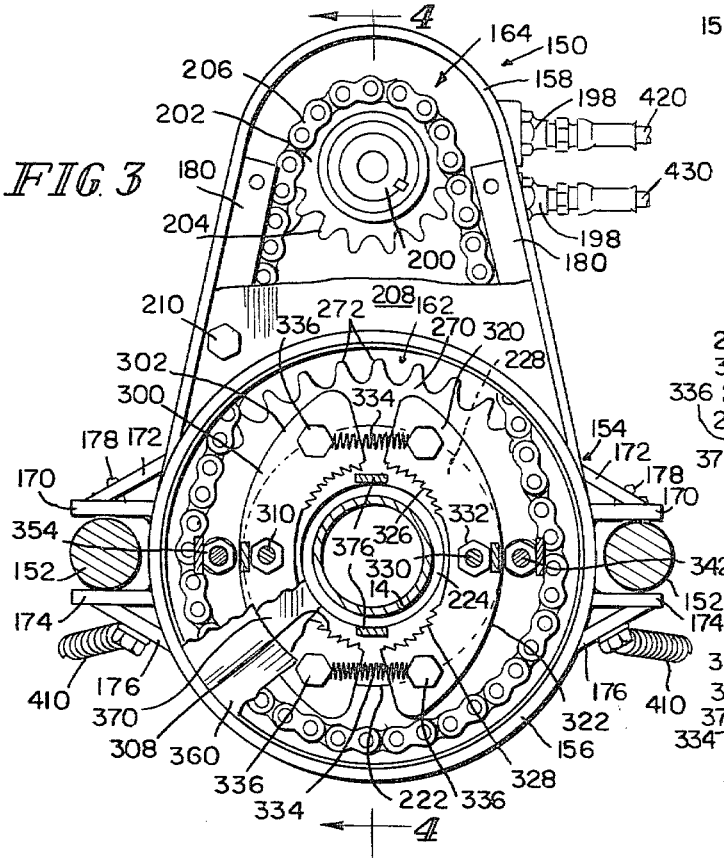
FIG. 3 is a transverse end view, partly broken away and cross-sectioned, of the power-driven apparatus of the present invention, taken generally along transverse section lines 3—3 of the pipe-handling mechanism of FIG. 2.

In general, the apparatus of the present invention is employed to connect and disconnect two sections of pipe where one of the sections is clamped and prevented from rotating by a stationary structure such as a pipe-handling mechanism, and the other section of pipe is rotated relative to the one section of pipe in either a clockwise or counterclockwise direction by the apparatus of the present invention.

For illustrative purposes, the apparatus of the present invention is shown and will be described in relation to a pipe-handling mechanism of the type disclosed in my co-pending application entitled VEHICULAR MOUNTED PIPE PRESSER, Ser. No. 75,702, filed Sept. 14, 1979. It should be understood, however, that the present invention is also adaptable to other well-known pipe-handling mechanisms, and therefore its use and operation is not intended to be limited to the particular pipe-handling mechanism shown and described herein.

Importantly, the apparatus of the present invention should be used in conjunction with a pipe-handling mechanism or other equipment which is capable of preventing one pipe section from rotating while another pipe section is rotated by the apparatus to connect or disconnect the two pipe sections. Otherwise, both sections of pipe will be rotated by the apparatus.

One significant advantage of the power-driven apparatus of the present invention is that it is capable of rotating a pipe section in either one of two directions without reversing or adjusting the position of the apparatus. Another significant advantage of the present invention is that the grip on the pipe section is increased as the force necessary to rotate the pipe section is increased, to thereby prevent slippage or release of the grip and allow greater pressure and force to be applied to the pipe section. These significant advantages of the present invention make the power-driven apparatus adaptable for use in applications where it has heretofore been impractical or impossible to use conventional pipe-rotating devices. Furthermore, the improvements associated with the apparatus of the present invention provide a smoother and more efficient operation in relation to conventional pipe-rotating devices.

Referring now more particularly to the drawings, a pipe-handling mechanism 10 of the type disclosed in my aforementioned co-pending application is shown in FIGS. 1 and 2 for purposes of illustrating the adaptation and use of the power-driven apparatus of the present invention. The pipe-handling mechanism 10 shown in FIGS. 1 and 2 includes a pipe-pressing assembly 12 for pressing pipe 14 through the ground 16. As illustrated, the pipe 14 will typically have a coupling device 18 connected to one of its ends for connecting numerous sections of pipe 14 thereto. It should be noted that these couplings 18 are in most instances greater in diameter than the pipe 14 itself.

As illustratively shown in FIG. 1, the pipe-pressing assembly 12 is typically used to press pipe through the ground 16 beneath the ground surface 20 in an excavation 22. The excavation 22 will naturally have a bottom 24 and at least two side walls 26 and 28 which are transverse to the pressing forces and movement of the pipe 14 through the ground 16. Power to provide the necessary forces to move the pipe 14 will be typically supplied by a hydraulic power supply (not shown) employing a hydraulic fluid which is typically supplied to the pipe-handling mechanism 10 from a vehicle by a series of controls and hydraulic fluid supply lines (not shown).

Continuing to refer to FIGS. 1 and 2, the pipe-pressing assembly 12 includes a frame 40 having a stationary frame structure 42 including two parallel channels 44 for slidably receiving two movable frame structures 55. As best illustrated in FIG. 1, the two parallel channels 44 are connected by a cross brace 48 to form a single pipe-handling unit. It should be noted that other cross braces serving other functions in addition to connecting the two channels 44 are also welded or connected to the channels 44 to form the stationary frame structure 42. Each movable frame structure 46 includes two parallel rails 50 slidably positioned within the channels 44 and pivotally connected to end plates 52, 54 at points 56, 58, respectively. Importantly, it should be understood that the rails 50 for plates 52, 54 are not connected to each other and in fact are separate units received by the channels 44.

The front end plate 52 is rectangular in shape and is projectable to engage the front wall surface 26 of the excavation 22. Two double-action or bi-directional hydraulic piston and cylinder mechanisms 60 are supported by the stationary frame structure 42 at points 62 in parallel with and in generally the same plane as each of the two parallel channels 44. Each mechanism 60 is also pivotally connected to the front end plate 52 at points 56 so that end plate 52 is rotatable to conform to the front wall surface 26. The end plate 52 includes a U-shaped gate or aperture (not shown) for receiving and guiding the pipe 14 through the ground 16. In most instances, it is desirable that a portion of the pipe 14 protrude from the surface 26 after the pressing has been completed so that additional pipe or other apparatus may be coupled to the protruding end.

The rear end plate 54 is also rectangular in shape and is projectable to engage the rear wall surface 28 of the excavation 22. Two double-action or bi-directional hydraulic piston and cylinder mechanisms 60 are supported by the stationary frame structure 42 at points 62 in parallel with and in generally the same plane as each of the two parallel channels 44. The rear end plate 54 is also pivotally connected to the hydraulic mechanisms 60 at points 58 to thereby allow the rear end plate 54 to rotate and conform to the rear wall surface 28 of the excavation 22.

A stage 60 is centrally carried by the stationary frame structure 42 and includes two halves 72, 74 which form a central channel therebetween for receiving and guiding the pipe 14 in a path parallel to the channels 44 and the hydraulic mechanisms 60. The stage 70 is provided to allow the operator of the pipe-pressing assembly 12 to position himself on the stationary frame structure 42 and control the operation of the assembly 12 from that location.

Figure 11:
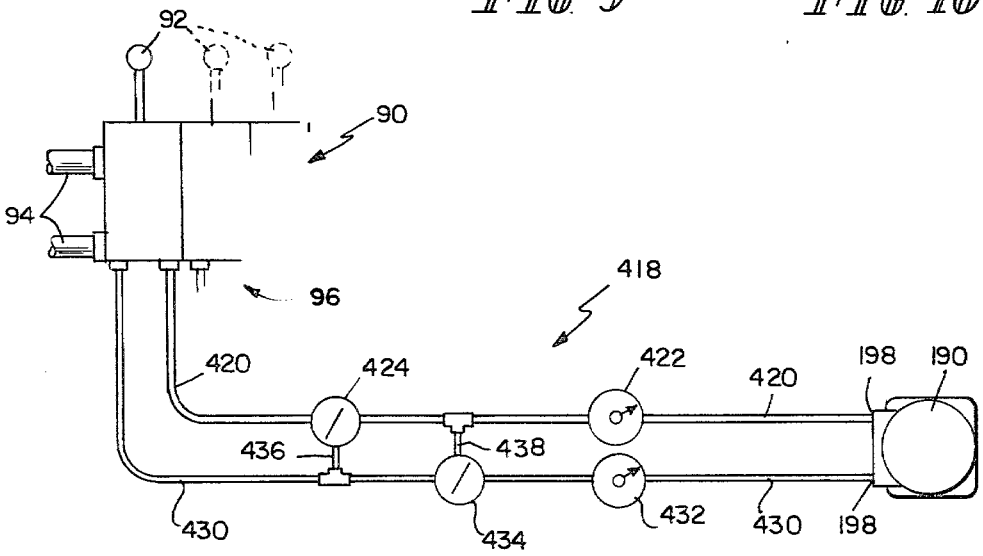
FIG. 11 is a diagrammatic representation of one embodiment of a system for controlling the operation of the power-driven apparatus of the present invention.

Upstanding from the stationary frame structure 42 is a stationary H-frame structure 80 including two posts 82 mounted perpendicular to the stationary frame structure 42. Positioned on the stationary H-frame structure 80 are a series of hydraulic controls 90 as diagrammatically illustrated in FIG. 11, each having a control lever 92. As best illustrated in FIG. 11, hydraulic fluid supply lines 94 including a supply and return line are extended from the hydraulic controls 90 and coupled to a hydraulic power supply (not shown). The hydraulic system lines 96 connecting the various hydraulic mechanisms of the assembly 12 with the hydraulic controls 90 may be mounted along one of the H-frame posts 82 to fix them out of the way of the operator.

Continuing to refer to FIGS. 1 and 2, the pipe-pressing assembly 12 further includes a movable clamping mechanism 100 which is carried by the channels 44 of the stationary frame structure 42. The clamping mechanism 100 includes a housing 102 having an upper surface 104 slidably engaging the top surfaces of the channels 44 and a lower surface 106 which slidably engages inner side surfaces of the channels 44 to guide movement of the housing 102 along the stationary frame structure 42. The housing 102 of the clamping mechanism 100 further includes a central chamber 108 for receiving a portion of the pipe 14. Provided within the central chamber 108 is one or more movable clamps 110 for grasping and clamping the portion of the pipe 14 received by the central chamber 108 of the housing 102. As long as the clamp 110 engages the pipe 14, rotational and axial movement of the pipe is prevented.

Two double-action or bi-directional hydraulic piston and cylinder mechanisms 112 are supportable by the stationary frame structure 42 at points 114, as best illustrated in FIG. 1, and are mounted in parallel to the housing 102 at points 116. The housing 102 is therefore bi-directionally movable along the stationary frame structure 42 in response to actuation of the hydraulic mechanisms 112.

In order to provide a further guide for the movement of the housing 102, L-shaped guides 118 are welded to an outer side surface of the channels 44 and cover the top surface 104 of the housing 102.

The clamping mechanism 100 further includes a floating H-frame structure 120 mounted to the housing 102 so that the H-frame 120 moves in association with the movement of the housing 102. The H-frame structure 120 includes two parallel upstanding channels 122 for slidably receiving and guiding a cross member 124 wherein the cross member 124 is allowed to move up and down along the channels 122. Connected to the cross member 124 and the movable clamp 110 is another double-action or bi-directional hydraulic mechanism 126 for controlling the clamping actions of the clamp 110.

As generally illustrated in FIGS. 1 and 2, a power pipe tong 150 for gripping and rotating a pipe section 14 in either a clockwise or counterclockwise direction to connect and disconnect the pipe section 14 to another pipe section 14 which has previously been pressed into the ground 16 by the pipe-pressing assembly 12 is movably carried on the stationary frame structure 42 by the movable shafts 152 of the hydraulic cylinder mechanisms 112 associated with the movable clamping mechanism 100. The power-driven pipe tong 150 includes a housing or carriage 154 which is mountable on or carried by the pipe-pressing assembly 12 in line and in generally the same plane with the central chamber 108 of the movable clamping mechanism 100.

Figure 4:
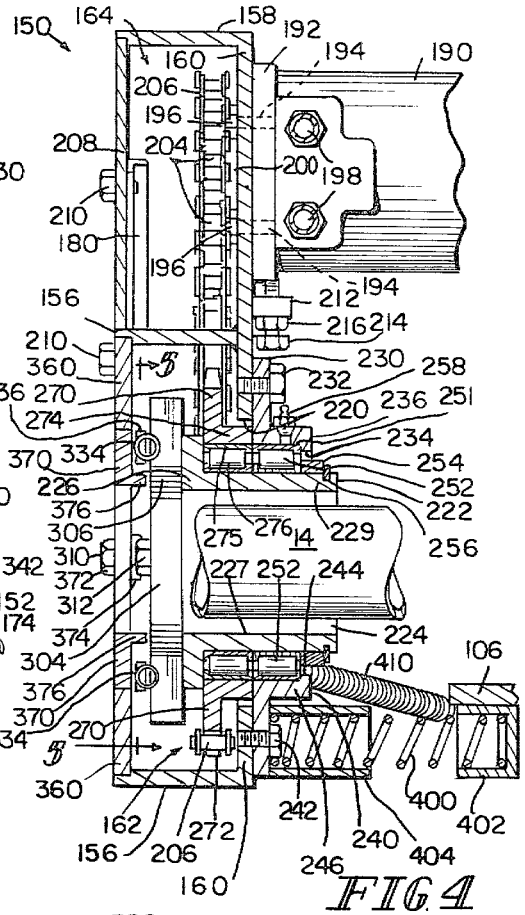
FIG. 4 is a partial cross-sectional view of the apparatus of the present invention, taken generally along section lines 4—4 of FIG. 3.

Referring now more particularly to FIGS. 3 and 4, the housing or carriage 154 of the pipe tong 150 includes a lower generally cylindrical-shaped housing section 156 and an upper generally hyperbolic-shaped housing section 158 secured to the cylindrical housing section 156 by welding or other conventional means. Attached to both housing sections 156, 158 is a back panel 160 which thereby provides a first open chamber 162 formed in the lower section 156 of the housing 154 and a second open chamber 164 formed in the upper section 158 of the housing 154.

Secured to the outer surface of the housing or carriage 154 are outwardly projecting means for movably supporting the housing or carriage 154 relative to a stationary structure 42 of a pipe-handling mechanism 10. It should again be noted that the pipe-handling mechanism 10 shown in FIGS. 1 and 2 has been illustrated for purposes of describing the adaptation of the power tong 150 of the present invention in conjunction with a particular application and it is therefore not intended that the use of the power tong 150 be limited to the pipe-handling mechanism 10 shown in FIGS. 1 and 2. The means for movably supporting the housing or carriage 154 includes upper flanges 170 projecting outwardly in opposed directions from the housing 154 and reinforced relative to the housing 154 by oblique inclined upper reinforcement braces 172. Also outwardly projecting from opposed sides of the housing 154 and in spaced parallel relationship to the upper flanges 170 are lower flanges 174 which are also reinforced by lower oblique inclined reinforcement braces 176. The flanges 170, 174 and reinforcement braces 172, 176 are secured to the housing 154 by welding or other conventional means. In order to provide lubrication for movement of the housing or carriage 154 relative to the stationary frame 42 during operation of the power tong 150, the flanges 170, 174 are provided with grease fittings 178.

As can best be seen in FIGS. 1 and 2, the upper housing section 158 includes two mounting brackets 108 to which a front cover plate can be mounted to close the second open chamber 176 of the housing or carriage 154.

Figure 9:
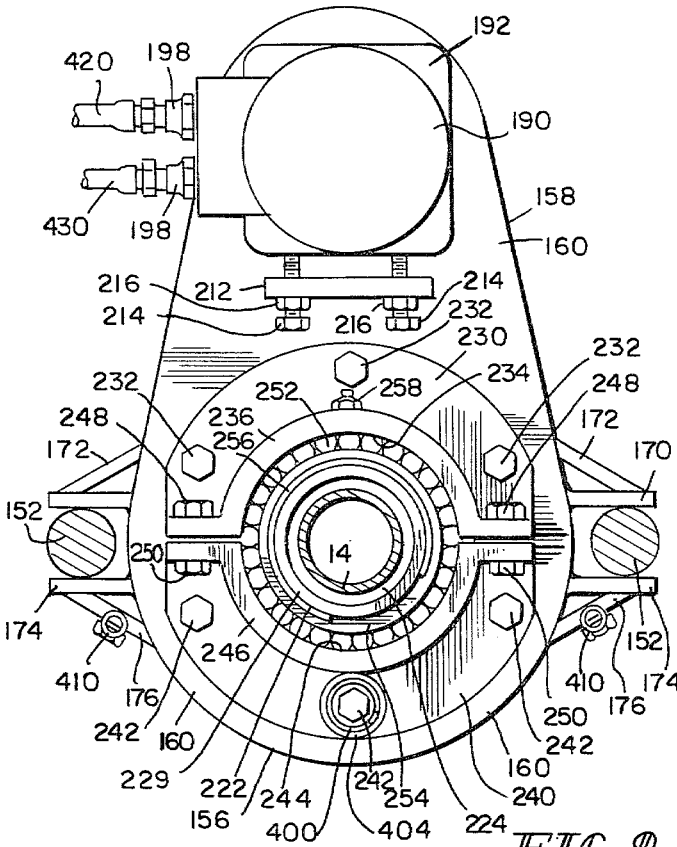
FIG. 9 is a transverse end view, partly cross-sectioned, of the apparatus of the present invention, taken generally along transverse section lines 9—9 of the pipe-handling mechanism of FIG. 2.
Figure 10:
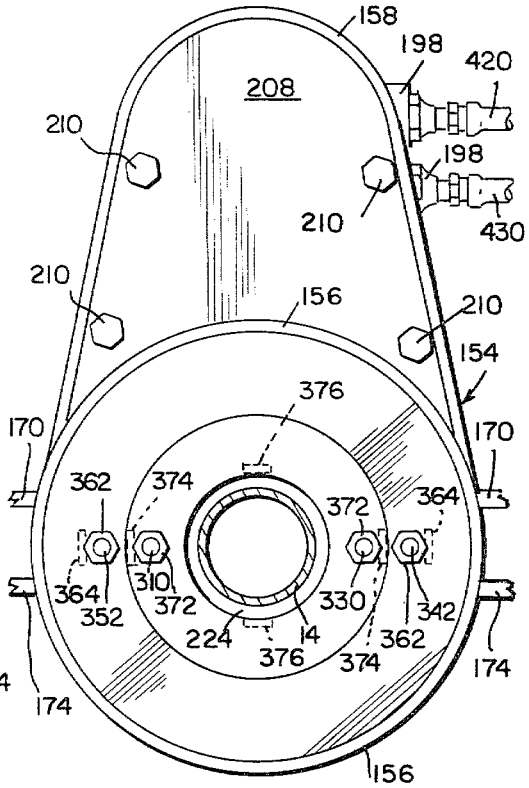
FIG. 10 is a transverse end view of the apparatus of the present invention, which is generally the same as the end view of FIG. 3, but which is neither cross-sectioned nor broken away.

Referring now to FIGS. 4 and 9, a bi-directional hydraulic motor 190 such as, for example, the Model No. 8-114 H-Series motor manufactured by the Fluid Power Operations, Eaton Corporation, Eden Prairie, Minnesota, is mounted to the back panel 160 adjacent the second open chamber 164 of the housing 154 by a movable mounting bracket 192. Mounting bracket 192 is secured to the back panel 160 by bolts 194 and nuts 196 which may be loosened to adjust the position of the hydraulic motor 190 for reasons which will be described later.

Coupled to the bi-directional hydraulic motor 190 are two hydraulic fluid line connectors 198 for connecting hydraulic fluid supply and return lines and a rotating shaft 200 which, when the motor 190 is mounted to the back panel 160 of the housing 154, projects into the second open chamber 164 through an opening provided in the back panel 160 of the housing 154. Mounted to the shaft 200 of the hydraulic motor 190 is a first rotatable sprocket wheel 202 which is rotatable simultaneously with the shaft 200 of the hydraulic motor 190 in both clockwise and counterclockwise directions. The sprocket wheel 202 includes a series of cogs or teeth 204 for engaging an endless driving means 206 such as a chain consisting of a plurality of links. A front cover plate 208 having a generally hyperbolic shape similar to the shape of upper housing section 158 of the housing 154 is mounted to the cover mounting brackets 180 by bolts 210 to close the second open chamber 164.

Also mounted to the back panel 160 beneath the mounting bracket 192 for the hydraulic motor 190 is a means for adjusting the tension of the endless driving means 206 by moving the mounting bracket 192 and hydraulic motor 190. The tension-adjusting means includes an outwardly projecting flange secured to the back panel 160 by welding or other conventional means, two bolts 214, each threadable through the flange and engaging the mounting bracket 192, and nuts 216 for securing the position of the motor 190 and mounting bracket 192. Accordingly, by loosening the bolts 194 and nuts 196 of the mounting bracket 192, the bracket 192 can be incrementally moved upward or downward to adjust the tension of the endless driving means 206.

Continuing to refer to FIGS. 4 and 9, the back panel 160 of the housing 154 further includes a circular opening 220 for rotatably supporting a rotatable member 222 having a hollow cylindrical passageway 224 for receiving a pipe section 14. One end 226 of the rotatable member 222 includes a radially extending, outwardly projecting flange 228 around the outer periphery thereof. The opposite end 229 of the rotatable member 222 extends axially outward from the back panel 160 of the housing 154. Means for rotatably supporting the rotatable member 222 relative to the housing 154 includes an upper semicircular mounting plate 230 which is secured to the back panel 160 adjacent the circular opening 220 by three bolts 232 and which includes an arcuate inner edge 234 and an outwardly extending flange 236 projecting therefrom. Further, the supporting means includes a lower semicircular mounting plate 240 which is secured to the back panel 160 adjacent the circular opening 220 by three bolts 242 and which also includes an arcuate inner edge 244 opposite the edge 234 of the upper semicircular mounting plate 230 and an outwardly extending flange 246 projecting therefrom. As can best be seen in FIG. 9, the upper and lower semicircular mounting plates 230 are joined by bolts 248 passing through the flanges 236, 246 and nuts 250.

The combined arcuate inner edges 234, 244 of the upper and lowering mounting plates 230, 240, respectively, form a circular inner surface including a bearing race 251 for rotatably retaining a plurality of roller bearings 252. The roller bearings 252 are rotatably retained between the bearing race 251 and the cylindrical rotatable member 222 so that the member 222 is rotatable relative to the mounting plates 230, 240 and housing 154. Sleeved over the axially outwardly projecting end 229 of the rotatable member 222 and engaging the roller bearings 252 to limit axial movement of the rotatable member 222 to maintain proper positioning of the bearings 252 is a washer 254. A C-shaped keeper spring 256 is retained in a notch formed in the circumference of the end 229 of the rotatable member 222 to retain the washer 254 in position against the bearings 252. In order to lubricate the roller bearings 252, a grease fitting 258 is provided in the flange 236 of the upper mounting plate 230, as best illustrated in FIG. 9.

Rotatably supported by the rotatable member 222 between the flange 228 and upper and lower mounting plates 230, 240 is a second rotatable sprocket wheel 270 which, as can best be seen in FIG. 3, is larger in diameter than the first sprocket wheel 202. The sprocket wheel 270 is rotatable independently of the rotatable member 222 and includes a series of teeth or cogs 272 for also engaging the endless driving means 206. Accordingly, second sprocket wheel 270 is rotated in response to rotation of first sprocket wheel 202 which, as previously described, is rotated by the bi-directional hydraulic motor 190.

Referring specifically to FIG. 4, the sprocket wheel 270 includes an axially extending flange 274 which engages the mounting plates 230, 240 and provides a circular inner surface including a bearing race 275 for rotatably retaining a plurality of roller bearings 276 which are positioned in tandem with and independently rotatable with respect to roller bearings 252. It should be noted that because of the tandem relationship of the roller bearings 276 and 252, the grease fitting 258 also serves to supply lubricant to the bearings 276.

Pivotally connected to the flange 228 of the rotatable member 222, and therefore rotatable simultaneously therewith, is a first arcuate jaw or clamp 300. As illustrated in FIG. 3, the first jaw 300 includes an arcuate outer surface 302 and an arcuate inner surface 304. The inner surface 304 includes an upper series of angular teeth 306 and a lower series of angular teeth 304 for gripping the pipe 14. Importantly, the upper and lower series of teeth 306, 308 are angled in opposed directions so that the upper series of teeth 306 can grip the pipe 14 for rotation in a first direction, and the lower series of teeth 308 can grip the pipe 14 for rotation in a second direction. It should also be noted that the arcs of the inner surface 304 and the outer surface 302 are different so that the ends of the arcuate jaw 300 are flared outward for reasons which will become apparent later. The first jaw 300 is pivotally connected to the flange 228 at a point on the jaw 300 approximately equidistant between its ends by a pin or bolt 310 which is threaded to receive a nut 312.

Continuing to refer to FIG. 3, a second arcuate jaw or clamp 320 is also pivotally connected to the flange 228 of the rotatable member 222 in spaced and diametrically opposed relationship to the first jaw 300. The second jaw 320 likewise includes an arcuate outer surface 322 and an arcuate inner surface 324. The inner surface 324 includes an upper series of angular teeth 326 and a lower series of angular teeth 328 which are angled in opposed directions for the purpose of gripping the pipe 14 when the pipe is rotated in the first and second directions. Importantly, the upper series of teeth 306 of the first jaw 300 and the lower series of teeth 328 of the second jaw 320 are angled in generally the same direction to cooperatively grip the pipe 14 when the pipe 14 is being rotated in a clockwise direction as viewed in FIG. 5. Furthermore, the lower series of teeth 308 of the first jaw 300 and the upper series of teeth 326 of the second jaw 320 are likewise angled in generally the same direction so that they cooperatively grip the pipe 14 when the pipe 14 is being rotated in a counterclockwise direction as viewed in FIG. 6. The second jaw 320 is also pivotally connected to the flange 228 at a point on the jaw 320 approximately equidistant from its ends by a pin or bolt 330 which is threaded to receive a nut 332.

As can further be seen in FIG. 3, adjacent ends of the first and second jaws 300, 320 are coupled together by expansion springs 334 which are secured to the adjacent ends by bolts 336 to continuously bias the jaws 300, 320 toward a neutral or open position, as viewed in FIG. 3, so that the pipe 14 can be passed through the rotatable member 222 and between the jaws 300, 320.

Referring now to FIGS. 3, 5, 6, and 8, the second rotatable sprocket wheel 270 supports two cantilevered roller bearings 340, 350 which are positioned to engage the outer arcuate surfaces 302, 322 of the jaws 300, 320, respectively. As best illustrated in FIG. 3, in the neutral or open position of the jaws 300, 320, the roller bearing 340 is supported on the sprocket wheel 270 by a pin 342 in generally the same horizontal plane as the pivotal point (pin 330) for the jaw 320. The pin 342 is threaded on one end to receive a nut 344 to rotatably retain the bearing 340 on the pin 342. Further, in the neutral or open position of the jaws 300, 320, the roller bearing 350 is supported on the sprocket wheel 270 by a pin 352 in generally the same horizontal plane as the pivot point (pin 310) for the jaw 300. The pin 352 is likewise threaded on one end to receive a nut 354 to rotatably retain the bearing 350 on the pin 352.

Figure 8:
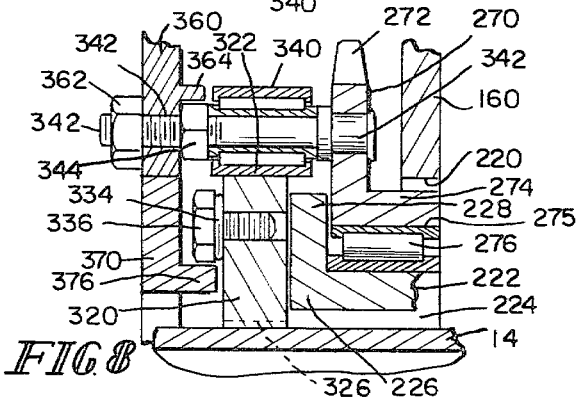
FIG. 8 is a cross-sectional view of a portion of the section of the apparatus shown in FIG. 6, taken generally along section lines 8—8 of FIG. 6.

Referring now to FIGS. 3, 5, 6, 8, and 10, an outer circular front cover plate 360 is secured by nuts 362 to the threaded pins or shafts 342, 352 which rotatably carry the roller bearings 340, 350, respectively. Importantly, the outer cover plate 360 fits within the circular housing section 156, as best illustrated in FIG. 4, and is rotatable with respect to the housing section 156 in conjunction with the rotation of sprocket wheel 270. It should therefore be noted that the outer cover plate 360 serves to support the cantilevered pins 342, 352 and the roller bearings 340, 350, respectively. Provided on the inner surface of the outer front cover plate 360 are two opposed axially inwardly projecting nut-keeper flanges 364 which, as best illustrated in FIG. 8, engage a flat surface of the hexagonal nuts 344, 354 which retain the bearings 340, 350 to prevent rotation and loosening of the nuts 344, 354 once the outer front cover plate 360 is secured in position.

Continuing to refer to FIGS. 3, 5, 6, 8, and 10, an inner circular front cover plate 370 is secured by nuts 372 to the threaded pins 310, 330 which pivotally carry or support the jaws 300, 320, respectively. Importantly, the inner front cover plate 370 has an outer diameter which is generally equal to the inner diameter of the outer front cover plate 360 so that the inner front cover plate 360 is retained within the outer front cover plate 360 and is rotatable relative thereto. It should therefore be noted that the inner front cover plate 370 serves to support the cantilevered pins 310, 330 and the jaws 300, 320, respectively. Located in proximity to the outer periphery of the circular inner front cover plate 370 are two opposed axially inwardly projecting nut-keeper flanges 374 which engage a flat surface of the hexagonal nuts 312, 332 which pivotally retain the jaws 300, 320 to prevent rotation and loosening of the nuts 312, 332 once the inner front cover plate is secured in position.

The circular inner front plate 370 also includes a concentric circular opening for allowing the pipe 14 to pass through the power tongs 150. Provided in proximity to the concentric circular opening in opposed relationship and 90° out of phase with the nut-keeper flanges 374 are two axially inwardly projecting stop-limit flanges 376 which limit pivotal movement of the jaws 300, 320 in a manner to be described later.

Figure 6:
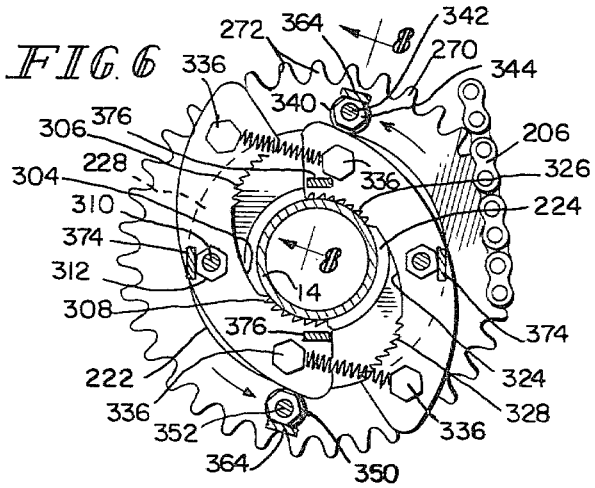
FIG. 6 is a sectional view, partly cross-sectioned, of the apparatus of the present invention shown in FIGS. 3 and 4, taken generally along section lines 5—5 of FIG. 4, which illustrates the apparatus in another mode of operation.
Figure 5:
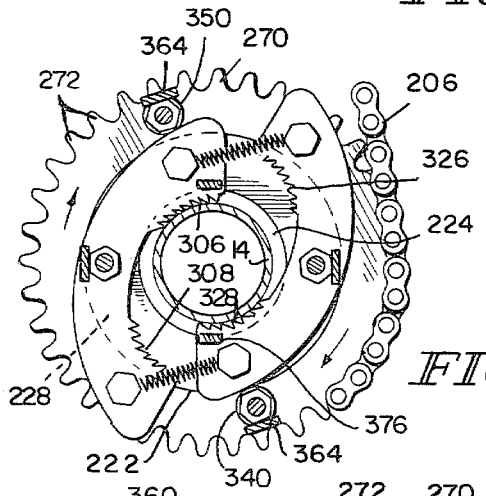
FIG. 5 is a sectional view, partly cross-sectioned, of the apparatus of the present invention shown in FIGS. 3 and 4, taken generally along section lines 5—5 of FIG. 4, which illustrates the apparatus in one mode of operation.

The operation of the jaws 300, 320 to grip the pipe 14 and rotate it in either a clockwise or counterclockwise direction can best be described by referring to FIGS. 5 and 6, respectively. Referring first to FIG. 5, when the sprocket wheel 270 is rotated in the clockwise direction, as indicated by the arrows in FIG. 5, the roller bearings 340, 350 are correspondingly rotated and follow the arcuate outer cam surfaces 302, 322 of the jaws 300, 320, respectively, thereby pivoting the jaws 300, 320 so that the upper series of teeth 306 of the first jaw 300 and the lower series of teeth 328 of the second jaw 320 engage and grip the pipe 14. Continued rotation of the sprocket wheel 270 in the clockwise direction causes the flared ends of the jaws 300, 320 to be wedged between the bearings 340, 350 so that frictional contact between the bearings 340, 350; jaws 300, 320; and the pipe 14 results in simultaneous rotation of the sprocket wheel 270, the rotatable member 222, and the pipe 14 in the clockwise direction. It should be noted that an increase in rotational force applied by the sprocket wheel 270 in response to the hydraulic motor 190 causes a corresponding increase in the pressure applied to the jaws 300, 320 by the bearings 340, 350 to thereby increase the grip of the jaws 300, 320 on the pipe 14. Accordingly, the more force required to rotate the pipe 14, the tighter the grip of the jaws 300, 320 on the pipe 14 to prevent slippage or release of the grip.

Referring to FIG. 6, the operation of the jaws 300, 320 for rotating the pipe 14 in the counterclockwise direction is generally the same as that described above for rotating the pipe in the clockwise direction. When the sprocket wheel 270 is rotated in the counterclockwise direction, as indicated by the arrows in FIG. 6, the roller bearings 340, 350 are correspondingly rotated and follow the arcuate outer cam surfaces 302, 322 of the jaws 300, 320, respectively, thereby pivoting the jaws 300, 320 so that the upper series of teeth 326 of the second jaw 320 and the lower series of teeth 308 of the first jaw 300 engage and grip the pipe 14. Continued rotation of the sprocket wheel 270 in the counterclockwise direction causes the flared ends of the jaws 300, 320 to be wedged between the bearings 340, 350 so that frictional contact between the bearings 340, 350; jaws 300, 320; and the pipe 14 results in simultaneous rotation of the sprocket wheel 270, the rotatable member 222, and the pipe 14 in the counterclockwise direction. An increase in rotational force applied by the sprocket wheel 270 in response to the hydraulic motor 190 causes a corresponding increase in the pressure applied to the jaws 300, 320 by the bearings 340, 350 to thereby increase the grip of the jaws 300, 320 on the pipe 14. Therefore, the more force required to rotate the pipe 14, the tighter the grip of the jaws 300, 320 on the pipe 14 to prevent slippage or release of the grip.

As can be seen in FIGS. 5, 6, and 8, the stop-limit flanges 376 provided on the inner front cover plate 370 serve to limit the pivotal movement of the jaws 300, 320 in either direction in response to rotation of the sprocket wheel 270 when the nuts 336 holding the expansion springs 334 engage the flanges 376. However, the stop-limit flanges 376 are positioned so that the teeth 306, 328 or 308, 326 engage and grip the pipe 14 before the bolts 336 engage the flanges 376, and preferably there should be additional space between the flanges 376 and the nuts 336 even after the teeth 306, 328 or 308, 326 have engaged the pipe 14 to allow further tightening of the grip.

It should be noted that when the sprocket wheel 270 is rotated so that the roller bearings 340, 350 are in line with the pivotal connections for the jaws 300, 320, the jaws are automatically returned to their neutral or open position, as illustrated in FIG. 3, by the biasing expansion springs 334.

Figure 7:
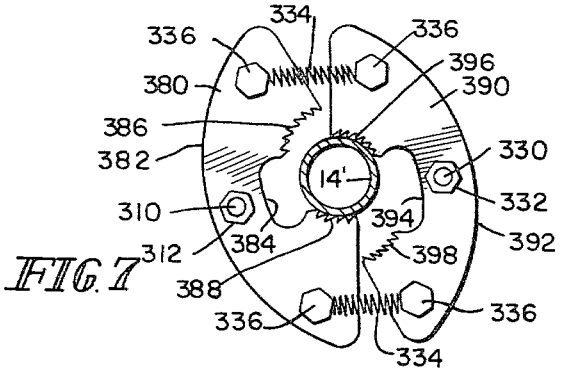
FIG. 7 is a fragmentary view of the apparatus of the present invention shown in FIGS. 3–6, which illustrates a further embodiment thereof.

Illustrated in FIG. 7 is another embodiment of means for gripping a pipe 14′ having an outer diameter which is smaller than the outer diameter of the pipe 14. Diagrammatically shown in FIG. 7 is a first jaw 380 having an arcuate outer surface 382 and a generally U-shaped inner surface 384 which includes inwardly projecting legs having an upper series of angular teeth 386 and a lower series of angular teeth 388. A second spaced and diametrically opposed jaw 390 also has an arcuate outer surface 392 and a generally U-shaped inner surface 394 which includes inwardly projecting legs having an upper series of angular teeth 396 and a lower series of angular teeth 398. It can be appreciated that with the generally U-shaped inner surfaces 384, 394 of the jaws 380, 390, respectively, the teeth 386, 388, 396, 398 are positioned relatively closer to each other than in the case of jaws 300, 320 previously described. Therefore, pivotal movement of the jaws 380, 390 allows the teeth 386, 398 or 396, 388 to grip pipe 14' of relatively smaller diameter.

One significant feature of power tong 150 of the present invention when it is used in conjunction with a material-handling mechanism 10, such as the pipe-pressing assembly 12 illustrated in FIGS. 1 and 2, is that it is movably supported so that it can move axially relative to the pipe 14 being handled. Accordingly, when two pipe sections 14 are being connected by rotation in one direction, i.e., one pipe section 14 is being threaded onto or into another pipe section 14, the power tong 150 is allowed to axially move to a first position as the pipe sections 14 are threaded together. As the direction of rotation of the one pipe section 14 is changed and the two pipe sections 14 are disconnected, the power tong 150 is allowed to axially move to a second position as the pipes are threadably disconnected and moved away from each other.

In association with this feature, means for biasing the power tong toward a neutral axial position from either the first or second axial positions is provided. The neutral axial position represents the position of the power tong 150 when the pipe 14 is initially inserted. The biasing means includes a compression spring 400 positioned within a bifurcated housing where the housing includes a first section 402 secured to the lower surface 106 of the movable clamping mechanism 100 of the pipe-pressing assembly 12 and a second section 404 carried by the housing 154 of the power tong 150. As the power tong 150 is drawn near to the movable clamping mechanism 100, the spring 400 is compressed so that when the grip of the power tong 150 on the pipe is released, the power tong 150 is returned to its neutral axial position by expansion of the spring 400. Also secured to the lower surface 106 of the movable clamping mechanism 100 and to the housing 154 of the power tong 150 are two expansion springs 410 which expand when the power tong is moved away from the movable clamping mechanism 100 and which return the power tong 150 to its neutral position when the grip on the pipe 14 is released. It can therefore be appreciated that when the pipe 14 is not being gripped it is being continuously biased toward its neutral position.

Means for controlling the operation of the bi-directional hydraulic motor 190 is provided by a hydraulic fluid system such as, for example, the hydraulic fluid system 418 illustrated in FIG. 11. It should be understood that various other hydraulic systems could be used to control and operate the motor 190; however, because of various safety features, the system 418 is one of the preferred systems for controlling the operation of the hydraulic motor 190. A hydraulic control 90 includes a multiple-position control lever 92 which is used by the operator to control the flow of hydraulic fluid to the motor 190, and thereby control the direction of rotation of the sprocket wheel 202 mounted to the shaft 200 of the hydraulic motor 190. The hydraulic control 90 is connected to a hydraulic fluid source (not shown) by hydraulic fluid lines 94 through a hydraulic fluid pump (not shown).

In many applications of the power tong 150, it may be desirable that the motor 190 initially rotate the sprocket wheel 202 at one speed and one pressure, and thereafter rotate the sprocket wheel 202 at another speed and pressure. For example, the motor 190 might initially be rotated at a fast speed at a low pressure when the load is small and thereafter rotated at a slow speed at a higher pressure when the load increases. Accordingly, the hydraulic fluid pump (not shown) could be either a standard single-stage pump or a two-stage pump, such as, for example, a pump of the 100 series type manufactured by Enerpac, Butler, Wis., and identified by Model No. FAM-1021. Importantly, it should be understood that a two-stage pump having the capability of providing increased speed and pressure can only be used where other components of the hydraulic system 418 are capable of withstanding the higher pressures. Of course, changes in speed and pressure could also be accomplished by a clutching mechanism for changing the drive ratio between the sprocket wheel 202 and the sprocket wheel 270. However, by employing a two-stage hydraulic pump, the operation of the power tong 150 is simplified while still providing the capability of operating at two or more speeds and pressures for various applications.

Referring to FIG. 11, the hydraulic system 418 includes a first hydraulic fluid system line 420 having one end connected to the hydraulic control 90 and the other end connected to the hydraulic line connector 198 of the hydraulic motor 190. Included in the first hydraulic line 420 is a pressure gauge 422 and an adjustable pressure-release valve 424. When the control lever 92 is placed in one of its operable positions, hydraulic fluid is pumped through the line 420 to the hydraulic motor 490 to rotate the hydraulic motor 190 in a first direction. In this action, a second hydraulic fluid system line 430 serves as a return line for returning hydraulic fluid contained in the opposite side of the hydraulic motor 190 to the fluid supply (not shown). The second hydraulic fluid line 430 is also connected to the hydraulic control 90 and to the other hydraulic connector 198 of the hydraulic motor 190 and includes a pressure gauge 432 and an adjustable pressure-release valve 434. When the control lever 92 is placed in a second operable position, hydraulic fluid is pumped through line 430 to the hydraulic motor 190 to rotate the motor 190 in a second direction. In this action, the first hydraulic line 420 serves as a return line for the hydraulic fluid. From each of these two operable positions of the control lever 92, the lever 92 is automatically returned to a third position to lock the hydraulic system 418 in its present state when the operator removes his hand from the lever 92.

The pressure gauges 422, 432 provide a visual indication to the operator of the amount of pressure being applied to the hydraulic motor 190 by the hydraulic fluid system 418 when the hydraulic lines 420, 430, respectively, are supplying fluid to the hydraulic motor 190 to rotate the motor 190 in first and second directions, respectively. The adjustable pressure-release valve 424 is connected to the hydraulic line 420 by a line coupling 436. This line coupling 436 in cooperation with the adjustable pressure-release valve 424 serves two purposes. Most importantly, by setting the pressure-release valve 424 at a desired pressure, the torque applied by the power tong 150 to the pipe 14 can be set. Second, this combination of valve 424 and line 436 assures that the forces being applied by the hydraulic motor 190 when rotating in the first direction do not surpass a limit point and thereby cause damage to the power tong 150 and/or pipe 14. When the hydraulic pressure in hydraulic line 420 reaches the desired value adjustably set at the pressure-release valve 424, valve 424 opens and hydraulic fluid is allowed to pass through the valve 424 to return line 430 to prevent a further increase in hydraulic pressure while the torque applied to the pipe 14 is maintained at the desired maximum level.

The pressure-release valve 434 included in hydraulic line 430 is also connected to the hydraulic line 420 through a line coupling 438. This line coupling 438 in cooperation with the adjustable pressure-release valve 434 also serves two purposes. Most importantly, they serve to set a desired torque limit for the power tong 150, and secondly to assure that the forces being applied by the hydraulic motor 190 when rotating in the second direction do not surpass a limit point and thereby cause damage to the power tong 150 and/or pipe 14. When the hydraulic pressure in line 430 reaches a desired value adjustably set at the pressure-release valve 434, valve 434 opens and hydraulic fluid is allowed to pass through the valve 434 to return line 420 to prevent a further increase in hydraulic pressure, while the torque applied to the pipe 14 is maintained at the desired maximum level.

Figure 12:
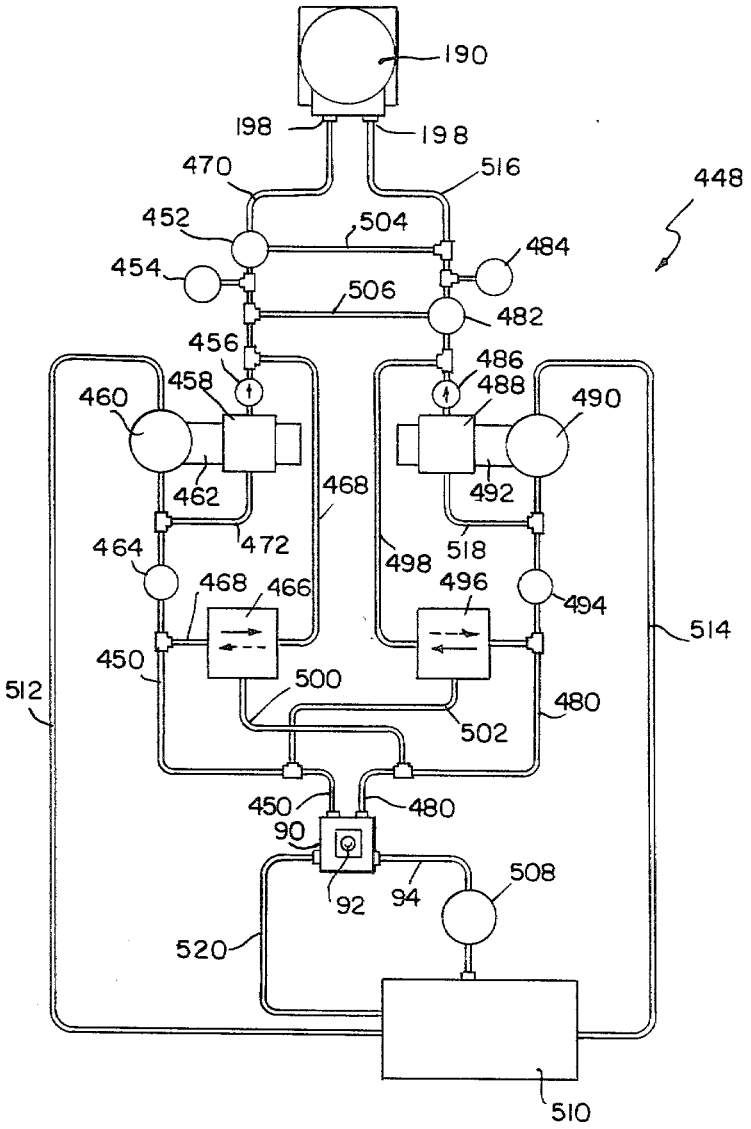
FIG. 12 is a diagrammatic representation of a further embodiment of a system for controlling the operation of the apparatus of the present invention.

An alternative hydraulic fluid system 448 which may be employed for controlling the operation of the bi-directional hydraulic motor 190 is illustrated in FIG. 12. The system 448 also provides the capability of operating the power tong 150 at two or more speeds and pressures for various applications, and further provides for greater pressures and torque limits than the system 418. Again, these features could be achieved mechanically by changing the drive ratio of the sprocket wheels 202, 270. The system 448 includes a hydraulic control 90 having a multiple-position control lever 92 which is connected through hydraulic fluid lines 94 and a hydraulic pump 508 to a hydraulic fluid tank or source 510. As will be described, the hydraulic system 448 can be used to apply various pressures and speeds to the rotation of the bi-directional hydraulic motor 190 using a single-stage hydraulic pump 508. It should also be noted that the hydraulic system 448 can include additional stages similar to those shown in FIG. 12 to further increase the speed and pressure capabilities of the system 448.

As illustrated in FIG. 12, the hydraulic system 448 includes a first hydraulic fluid system line 450 connected at one end to the hydraulic control 90. The system line 450 includes a first adjustable pressure-release valve 464 which in the illustrative embodiment should be adjustable for pressures between 0 and 2,000 psi. For a pump 508 having the capability of providing 2,000 psi of pressure, the pressure-release valve 464 will, for example, be set at 1,800 psi of pressure. Connected to the fluid system line 450 before the valve 464 is a fluid line 468 which includes a pilot-operated check valve 466, such as, for example, the valve manufactured by Enerpac, Butler, Wis., and identified as either Model No. V-65 or V-420. The check valve 466 normally allows fluid to flow therethrough in the direction of the solid arrow, as indicated in FIG. 12.

The fluid line 468 is in turn connected to a fluid line 470 which is connected at one end to a hydraulic line connector 198 of the hydraulic motor 190. The fluid line 470 includes a second adjustable pressure-release valve 452 located in proximity to the hydraulic motor 190 which, for reasons which will become apparent, should be adjustable for pressures between 5,000 and 10,000 psi. Also included in the fluid line 470 are a pressure guage 454 and a unidirectional check valve 456 which allows fluid to flow only in the direction of the arrow as indicated in FIG. 12. As can be seen in FIG. 12, the pressure-release valve 452 and pressure gauge 454 are included in line 470 on the side of the connection of fluid line 468 thereto which is closest to the motor 190, while the unidirectional check valve 456 is included in line 470 on the other side of the connection. The reasons for the specific locations of these valves 452, 456 and gauge 454 will become apparent from the following description of the operation of the system 448. p In operation, when the fluid pressure in system line 450 is below, for example, the 1,800 psi pressure setting of valve 464, the fluid flows to the right through pilot-operated check valve 466, as viewed in FIG. 12, through lines 468 and 470 to the motor 190 to rotate the power tong 150 in one direction at a first speed. When the fluid pressure in system line 450 exceeds the 1,800 psi pressure setting, valve 464 opens and fluid is allowed to flow through another fluid line 472.

Fluid line 472 includes means for intensifying or boosting the pressure of the fluid in the fluid line 470 to lower the speed and increase the torque of the motor 190. The pressure-intensifying or boosting means includes a hydraulic fluid pump 458 and a hydraulic fluid motor 460 whch is mechanically connected to the pump 458 by a connection 462 to increase the intensity with which the pump 458 forces the hydraulic fluid through the line 470. It should be noted that the pump 458, motor 460, and mechanical connection 462 therebetween could be interchanged with a hydraulic pressure intensifier such as the one manufactured by Enerpac, Butler, Wis., and identified as Model No. EB-65. Since the hydraulic pressure intensifier unit is only operable unidirectionally, the unidirectional check valve 456 would not be needed in the hydraulic line 470 when the hydraulic pressure intensifier is used. However, with the use of a separate hydraulic pump 458 the unidirectional check valve is necessary to prevent hydraulic fluid from returning through the hydraulic pump 458, as previously explained.

As will be explained in greater detail later, the pilot-operated check valve 466 also serves to provide a return line in the direction of the broken arrow, as viewed in FIG. 12, to bypass the unidirectional check valve 456 and the hydraulic pump 458 or intensifier when a second hydraulic fluid system line 480 is used as a supply line to rotate the power tong 150 in another direction. This occurs when the fluid pressure in system line 480 and a fluid line 500 connecting the system line 480 to the pilot-operated check valve 466 is great enough to trigger the valve 466 to allow the fluid to flow through valve 466 in the direction of the broken arrow.

The second system line 480 is connected at one end to the hydraulic control 90 and includes a first adjustable pressure-release valve 494 which in the illustrative embodiment should also be adjustable for pressures between 0 and 2,000 psi. For the pump 508 having the capability of providing 2,000 psi of pressure, the pressure-release valve 494 will, for example, also be set at 1,800 psi of pressure. Connected to the fluid system line 480 before the valve 494 is a fluid line 498 which includes a pilot-operated check valve 496, such as the type manufactured by Enerpac and previously referred to above. The check valve 496 normally allows fluid to flow therethrough in the direction of the solid arrow, as indicated in FIG. 12.

The fluid line 498 is in turn connected to a fluid line 516 which is connected at one end to a hydraulic line connector 198 of the hydraulic motor 190. The fluid line 516 includes a second adjustable pressure-release valve 482 located in proximity to the hydraulic motor 190 which, for apparent reasons, should also be adjustable for pressures between 5,000 and 10,000 psi. Also included in the fluid line 516 are a pressure gauge 484 and a unidirectional check valve 486 which allows fluid to flow only in the direction of the arrow as indicated in FIG. 12. As can be seen in FIG. 12, the pressure-release valve 482 and the pressure gauge 484 are included in line 516 on the side of the connection of fluid line 498 thereto which is closest to the motor 190, while the unidirectional check valve 486 is included in line 516 on the other side of the connection. The reasons for the specific locations of these valves 482, 486 and gauge 484 will become apparent from the following description of the operation of the system 448.

In operation, when the fluid pressure in system line 480 is below, for example, the 1,800 psi pressure setting of valve 494, the fluid flows to the left through pilot-operated check valve 496, as viewed in FIG. 12, through lines 498 and 516 to the motor 190 to rotate the power tong 150 in a second direction at a first speed. It will also be appreciated that the pressure in system line 480 will be great enough to trigger the pilot-operated check valve 466 to allow fluid to flow therethrough in the direction of the broken arrow, as viewed in FIG. 12, so that lines 450, 468, and 470 serve as return lines for the hydraulic fluid from the motor 190 which bypasses the unidirectional check valve 456 and the pump 458. When the fluid pressure in system line 480 exceeds the 1,800 psi pressure setting, valve 494 opens and fluid is allowed to flow through another fluid line 518.

Fluid line 518 includes means for intensifying or boosting the pressure of the fluid in the fluid line 516 to lower the speed and increase the torque of the motor 190. The pressure-intensifying or boosting means also includes a hydraulic fluid pump 488, a hydraulic fluid motor 490, and a mechanical connection 492 between the pump 488 and motor 490. Again, the pump 488, motor 490, and mechanical connection 492 could be replaced by the hydraulic pressure intensifier of the type described above.

Importantly, it should be noted that when the system line 450 serves as a supply line, the pilot-operated check valve 496 serves to provide a return line in the direction of the broken arrow, as viewed in FIG. 12, through lines 480, 498, and 516 to bypass the unidirectional check valve 486 and the hydraulic pump 488 or intensifier. When the fluid pressure in system line 450 and fluid line 502 connecting the system line 450 to the pilot-operated check valve 496 is great enough to trigger the valve 496, fluid is allowed to flow through the valve 496 in the direction of the broken arrow.

Hydraulic line couplings 504, 506 couple the adjustable pressure-release valve 452 in line 470 with the fluid line 516 and the pressure-release valve 482 in line 516 with the hydraulic line 470, respectively, to most importantly set a desired torque limit or maximum for the power tong 150, and secondly to assure that the forces being applied by the hydraulic motor 190 to the power tong 150 and/or the pipe 14 do not surpass a limit point and thereby cause damage to the power tong 150 and/or pipe 14. When the hydraulic pressure in the hydraulic lines 470, 516 reaches a desired value adjustably set at the pressure-release valves 452, 482, respectively, hydraulic fluid is allowed to pass through the valves 452, 482 to the return lines to release the pressure in the supply lines.

Further provided in the hydraulic system 448 are hydraulic fluid return lines 512, 514 connecting the hydraulic motors 460, 490, respectively, or pressure intensifiers, to the hydraulic fluid source 510 to provide a return path for the hydraulic fluid supplied to the hydraulic motors 460, 490 by lines 450, 480. In addition, a fluid return line 520 provides a return path for the hydraulic fluid from control 90 to the hydraulic fluid source 510. As can therefore be seen in FIG. 12, control 90 is a four-way control valve.

What is claimed is:

1. A power-driven apparatus for rotating a tubular member, comprising a housing, a first rotatable member including a hollow generally cylindrical-shaped portion for receiving the tubular member and a radially outwardly projecting flange in proximity to one end thereof, mounting means secured to the housing and including bearings for rotatably supporting the first rotatable member, a second rotatable member rotatably carried on the first rotatable member between the flange of the first rotatable member and the mounting means so that the second rotatable member is rotatable about the first rotatable member, the second rotatable member including bearings positioned in tandem with the bearings of the mounting means, at most two jaws, each having an arcuate outer surface and an arcuate inner surface, the inner surface of each jaw including upper and lower means for gripping the tubular member, means for pivotally mounting the jaws to the flange of the first rotatable member, the jaws having a non-gripping position to allow the tubular member to pass therebetween, means on the second rotatable member for engaging the outer arcuate surfaces of the jaws and pivoting the jaws inwardly in response to rotation of the second rotatable member to engage the tubular member in a gripping position, a bidirectional power means, coupling means between the power means and the second rotatable member for rotating the second rotatable member in first and second directions, the inner and outer arcuate surfaces of the jaws providing flared jaw ends for restricting movement of the engaging means along the outer surfaces when the gripping means engage the tubular member, and biasing means interconnecting first adjacent ends of the jaws and interconnecting second adjacent ends of the jaws for biasing the jaws toward the non-gripping position.

2. The apparatus as recited in claim 1 wherein rotation of the second rotatable member in the first direction causes the upper gripping means of one of the jaws and the lower gripping means of the other of the jaws to engage the tubular member in a first gripping position and rotate the first rotatable member and the tubular member in the first direction and rotation of the second rotatable member in the second direction causes the lower gripping means of the one jaw and the upper gripping means of the other jaw to engage the tubular member in a second gripping position and rotate the first rotatable member and the tubular member in the second direction.

3. The apparatus as recited in claim 2, further comprising means for limiting pivotal movement of the jaws.

4. The apparatus as recited in claim 3, further comprising an inner cover plate for the housing mounted to the first rotatable member by the means for pivotally mounting the jaws thereto, the inner cover plate being rotatable in conjunction with rotation of the first rotatable member.

5. The apparatus as recited in claim 4, further comprising an outer cover plate for the housing mounted to the second rotatable member, the outer cover plate being rotatable independent of the inner plate in conjunction with rotation of the second rotatable member, the housing retaining the outer cover plate and the outer cover plate retaining the inner cover plate in generally the same plane.

6. The apparatus as recited in claim 5 wherein the means for limiting pivotal movement of the jaws are provided on the inner cover plate and include opposed axially projecting flanges positioned in proximity to adjacent ends of the jaws when the cover plate is mounted to the first rotatable member.

7. The apparatus as recited in claim 3 wherein the jaws are pivotally mounted to the first rotatable member generally intermediate their respective ends in opposed spaced relationship to allow movement of their ends about first and second pivotal mounting means, respectively.

8. The apparatus as recited in claim 7 wherein the biasing means includes a first expansion spring interconnecting the first adjacent ends of the jaws and a second expansion spring interconnecting the second adjacent ends of the jaws.

9. The apparatus as recited in claim 8 wherein the upper and lower gripping means of each jaw includes a series of angular teeth, the upper series of teeth of each jaw having generally the same angle of inclination as the lower series of teeth of the opposing jaw.

10. The apparatus as recited in claim 9 wherein the second rotatable member includes a sprocket wheel and the coupling means includes an endless driving means engaging the sprocket wheel.

11. The apparatus as recited in claim 1 wherein the means for engaging the outer arcuate surfaces of the jaws includes two roller bearings rotatably cantilevered from the second rotatable member in diametrically opposed relationship to each other, the cantilevered roller bearings and the means pivotally mounting the jaws to the first rotatable member being located in generally the same plane when the jaws are in their non-gripping position.

12. The apparatus as recited in claim 11 wherein rotation of the second rotatable member simultaneously moves one of the cantilevered roller bearings along an upper portion of the outer arcuate surface of one of the jaws and the other of the cantilevered roller bearings along a lower portion of the outer arcuate surface of the other jaw to pivot inwardly the upper portion of the one jaw and the lower portion of the other jaw.

13. The apparatus as recited in claim 12 wherein movement of the cantilevered roller bearings along the outer arcuate surfaces of the jaws creates frictional contact between the jaws and the cantilevered roller bearings when the gripping means engage the tubular member whereby continued rotation of the second rotatable member after the gripping means engage the tubular member simultaneously rotates the tubular member and the first rotatable member.

14. In a pipe-handling mechanism of the type including a stationary frame structure, means carried on the frame for clamping and restricting rotation of a first pipe, and an axially movable power-driven apparatus for gripping and rotating a second pipe in first and second directions relative to the first pipe to connect and disconnect the pipes, respectively, the improvement wherein the clamping means includes a housing carried on the stationary frame, the housing having a central chamber for receiving a portion of the first pipe, at least one movable clamp in the central chamber and cooperating with the chamber to capture the portion of the first pipe, an H-frame structure mounted on the housing, the H-frame structure including two parallel channels and a cross member slidably received in the channels, and a double-acting piston and cylinder mechanism connected between the cross member and the movable clamp for moving the movable clamp to clamp the portion of the first pipe, and the gripping and rotating apparatus includes a housing carried on the stationary frame and axially movable with respect to the clamping means, the apparatus having a neutral axial position when the second pipe is not being gripped, a first axial position when the second pipe is gripped and rotated in the first direction, and a second axial position when the second pipe is gripped and rotated in the second direction, and means for biasing the apparatus toward the neutral axial position from both the first and second axial positions when the second pipe is released, a first rotatable means for receiving the second pipe, means for rotatably supporting the first rotatable means within the housing, first and second arcuate jaws, each having upper and lower means for gripping the second pipe, means for pivotally mounting the jaws to the first rotatable means, the jaws having a non-gripping position for allowing the second pipe to pass therethrough, a first gripping position for rotating the second pipe in the first direction and a second gripping position for rotating the second pipe in the second direction, second rotatable means rotatably carried on the first rotatable means, means carried on the second rotatable means for pivoting the jaws to grip the second pipe in the first and second gripping positions and through frictional contact with the jaws to rotate the second pipe and first rotatable means in the first and second directions.

15. The improvement as recited in claim 14 wherein the biasing means includes an expansion spring interconnecting the apparatus and the stationary frame and a compression spring interposed between the apparatus and the stationary frame, the springs applying counteracting forces to the apparatus to bias it toward the neutral axial position.

16. The improvement as recited in claim 14 wherein the apparatus further includes means for biasing the jaws toward the non-gripping position from both the first and second gripping positions.

17. The improvement as recited in claim 14, further comprising at least one other double-acting piston and cylinder mechanism connected between the stationary frame structure and the clamping means housing for axially moving the clamping means relative to the gripping and rotating apparatus.

* * * * *